US012716176B2

(12) United States Patent
Nordstrom et al.

(10) Patent No.: US 12,716,176 B2
(45) Date of Patent: Aug. 25, 2026

(54) ASSYMETRIC PAPERBOARD

(71) Applicant: BILLERUD AKTIEBOLAG (PUBL), Solna (SE)

(72) Inventors: Fredrik Nordstrom, Karlstad (SE); Johan Magnusson, Frovi (SE)

(73) Assignee: BILLERUD AKTIEBOLAG (PUBL), Solna (SE)

( * ) Notice: Subject to any disclaimer, the term of this patent is extended or adjusted under 35 U.S.C. 154(b) by 191 days.

(21) Appl. No.: 18/292,424

(22) PCT Filed: Aug. 11, 2022

(86) PCT No.: PCT/EP2022/072623
§ 371 (c)(1),
(2) Date: Jan. 26, 2024

(87) PCT Pub. No.: WO2023/017139
PCT Pub. Date: Feb. 16, 2023

(65) Prior Publication Data

US 2024/0376673 A1 Nov. 14, 2024

(30) Foreign Application Priority Data

Aug. 11, 2021 (EP) ..... 21190815

(51) Int. Cl.
*D21H 11/08* (2006.01)
*D21F 11/04* (2006.01)
(Continued)

(52) U.S. Cl.
CPC ..... *D21J 1/00* (2013.01); *D21F 11/04* (2013.01); *D21H 11/04* (2013.01); *D21H 11/08* (2013.01); *D21H 27/00* (2013.01); *D21H 27/30* (2013.01)

(58) Field of Classification Search
CPC ..... D21H 11/04; D21H 11/08; D21H 11/02; D21H 27/30; D21J 1/00; B32B 29/005
See application file for complete search history.

(56) References Cited

U.S. PATENT DOCUMENTS 4,913,773 A * 4/1990 Knudsen ..... D21H 27/38 162/149
6,068,732 A * 5/2000 Cassidy ..... D21F 11/04 428/56
(Continued)

FOREIGN PATENT DOCUMENTS

CA 2296435 C * 6/2004 ..... D21H 27/38
CN 111041892 A * 4/2020 ..... D21H 21/16
(Continued)

OTHER PUBLICATIONS

Latva-Kokko, Jenni; "Optmization of a new surface sizing process in the production of folding boxboard" 2017.
(Continued)

*Primary Examiner* — Jose A Fortuna
(74) *Attorney, Agent, or Firm* — Stites & Harbison PLLC; Richard S. Myers, Jr.

(57) ABSTRACT

There is provided a multi-layered paperboard comprising a first outer layer, a second outer layer and at least one middle layer arranged between the first and the second outer layer, wherein the grammage of the first outer layer is at least 2.0 times higher than the grammage of the second outer layer. A method of producing the multi-layered paperboard is also provided.

17 Claims, 2 Drawing Sheets

(51) Int. Cl.

| | |
|---|---|
| ***D21H 11/04*** | (2006.01) |
| ***D21H 27/00*** | (2006.01) |
| ***D21H 27/30*** | (2006.01) |
| ***D21J 1/00*** | (2006.01) |

(56) References Cited

U.S. PATENT DOCUMENTS

| | | | | |
|---|---|---|---|---|
| 6,190,744 | B1 * | 2/2001 | Akao | B32B 29/005 428/184 |
| 6,540,873 | B2 * | 4/2003 | Leandersson | D21F 3/0218 162/360.2 |
| 6,616,811 | B2 * | 9/2003 | Wassermann | D21F 11/08 162/133 |
| 6,855,228 | B1 * | 2/2005 | Perini | D21F 11/04 428/153 |
| 7,608,165 | B2 * | 10/2009 | Raisanen | D21F 9/006 162/217 |
| 7,892,613 | B2 * | 2/2011 | Meazle | D21H 27/30 428/35.9 |
| 7,988,825 | B2 * | 8/2011 | Aula | D21F 9/006 162/132 |
| 10,280,559 | B2 * | 5/2019 | Goyal | D21C 3/06 |
| 11,846,072 | B2 * | 12/2023 | Svending | D21H 21/10 |
| 11,926,128 | B2 * | 3/2024 | Lampainen | D21H 17/42 |
| 2002/0162636 | A1 * | 11/2002 | Halmschlager | D21F 11/04 162/298 |
| 2005/0039874 | A1 * | 2/2005 | Halmschlager | D21F 9/006 162/298 |
| 2006/0213630 | A1 * | 9/2006 | Bunker | D21H 23/10 162/146 |
| 2010/0047404 | A1 * | 2/2010 | Hallstrom | B32B 29/00 428/479.6 |
| 2013/0190154 | A1 * | 7/2013 | Babinsky | B32B 9/06 493/114 |
| 2018/0127919 | A1 * | 5/2018 | Goyal | D21H 11/06 |
| 2021/0002830 | A1 * | 1/2021 | Hietaniemi | D21H 23/28 |
| 2024/0376673 | A1 * | 11/2024 | Nordstrom | D21J 1/00 |
| 2025/0084592 | A1 * | 3/2025 | Nordstrom | D21H 27/38 |
| 2025/0250745 | A1 * | 8/2025 | Nordstrom | D21F 3/0218 |

FOREIGN PATENT DOCUMENTS

| | | | | |
|---|---|---|---|---|
| CN | 111088724 | A | 5/2020 | |
| CN | 211815173 | U * | 10/2020 | D21H 21/28 |
| CN | 113123173 | | 7/2021 | |
| DE | 4401761 | C2 * | 4/1997 | D21F 9/006 |
| EP | 0312512 | A1 * | 4/1989 | D21F 11/04 |
| EP | 1285132 | B1 | 2/2009 | |
| EP | 3816347 | A1 | 5/2021 | |
| EP | 3044371 | B1 | 7/2021 | |
| EP | 4105381 | A1 * | 12/2022 | D21H 11/14 |
| WO | WO2000014333 | A1 | 3/2000 | |
| WO | WO 2006/084883 | A1 | 8/2006 | |
| WO | WO-2008066487 | A1 * | 6/2008 | B32B 27/10 |
| WO | WO-2015087293 | A1 * | 6/2015 | C12Y 305/01028 |
| WO | WO-2019239334 | A1 * | 12/2019 | D21H 19/52 |
| WO | WO-2025202957 | A1 * | 10/2025 | D21F 11/04 |

OTHER PUBLICATIONS

Papermaking Science and Technology, Paper and Board Grades, Book 18, p. 58-60, published 2000.

Papermaking Science and Technology, Book 8, p. 227, published 2000.

"1.2 Uppbyggnad av flerskiktskartong" In: Papp och kartong, Skogsindustrins utbildning i Markaryd (SUM), Markaryd, 1995, 15-17.

* cited by examiner

ASSYMETRIC PAPERBOARD

CROSS REFERENCE TO RELATED APPLICATIONS

This application is a § 371 National Phase Application of PCT/EP2022/072623 filed Aug. 11, 2022, which claims priority to EP21190815.7 filed Aug. 11, 2021.

TECHNICAL FIELD

The present disclosure relates to the field of paperboard and in particular to paperboard for use in laminates for packaging of liquid food.

BACKGROUND

Conventional paperboard for use in liquid food packaging laminates has two outer layers of cellulose fibres (a print layer and a reverse layer) and at least one middle layer of cellulose fibres. The print layer may be provided with a pigment coating for improved printability and/or a more appealing appearance.

WO 2017/003364 discloses an oxygen barrier based on modified cellulose fibres. Various applications of the fibre-based barrier are suggested. One of them is as an oxygen-barrier layer in a multi-layered paperboard product. In this application, the paperboard and the oxygen-barrier layer may be produced independently of each other and then laminated together. No characteristics of the paperboard other than ranges for density and thickness are disclosed.

WO 2011/003565 discloses a laminate for packaging of liquid food. The laminate comprises e.g. paperboard and an oxygen barrier. In the laminate, the aluminium foil that is traditionally used as the oxygen barrier in liquid food packaging is replaced with a paper-based oxygen barrier, which preferably has a grammage of 30-60 g/m$^2$. It is further stated that the paperboard of the laminate may be a conventional paperboard of suitable packaging quality that has a grammage of 100-500 g/m$^2$ (preferably 200-400 g/m$^2$, more preferably 200-300 g/m$^2$).

Further details about a paper on which a barrier for a liquid food packaging laminate can be based are disclosed in WO 2017/089508, which also suggest to downgauge the cellulose-based bulk or core layer of the laminate in comparison to conventional liquid packaging paperboard. In more detail, it is suggested to replace the traditional paperboard with a spacer layer that has lower or no inherent bending stiffness and that is sandwiched between stiffness-enhancing layers. So-called foamed cellulose (a fibrous material) is given as an example of a suitable spacer layer.

SUMMARY

The present inventors have realized that in a packaging laminate including a paper-based barrier that makes a significant stiffness contribution, the paperboard should not be stripped down to merely a bulky core. Instead, the paperboard should have the conventional multi-layered structure, but in an unconventional grammage ratio adapted to the inclusion of the paper-based barrier. Thereby, existing paperboard machines can be used with no or minimal modifications, which is a crucial advantage given the investments made in building them. As an example, all the headboxes and all the wires of the conventional paperboard machine may still be utilized after switching to the paperboard of the present disclosure. Further, the middle layer(s) is (are) not exposed in the pressing and drying section during production of the paperboard of the present disclosure, which may be a significant advantage given the dusting issues often associated with the fibre composition of a typical middle layer.

In more detail, the paperboard of the present disclosure is asymmetric in the sense that the grammage of one outer layer has been reduced to the extent that it is half or less of the grammage of the other outer layer. This reduction may allow for an increase of the grammage of a bulkier middle layer. In such case, the paperboard of the present disclosure is not necessarily thinner than the conventional paperboard. Instead, it may actually be thicker since "high-density" pulp in the outer layer has been replaced with "low-density" pulp in the middle layer.

In its naked state, the design of the paperboard of the present disclosure makes no sense, but in a laminate also including a paper-based barrier, it is optimized and provides for increased bending stiffness and/or reduced fibre content/consumption.

Accordingly, the following itemized listing of embodiments of the present disclosure is provided:

1. A multi-layered paperboard comprising a first outer layer, a second outer layer and at least one middle layer arranged between the first and the second outer layer, wherein the grammage of the first outer layer is at least 2.0 times higher than the grammage of the second outer layer.
2. The multi-layered paperboard of item 1, wherein the grammage of the first outer layer is at least 2.5 times higher than the grammage of the second outer layer, such as at least 3.0 times higher than the grammage of the second outer layer.
3. The multi-layered paperboard of item 1 or 2, wherein the density of the at least one middle layer is below 550 kg/m$^3$, preferably below 490 kg/m$^3$, such as below 430 kg/m$^3$.
4. The multi-layered paperboard of any one of the preceding items, wherein the grammage of the multi-layered paperboard is 150-250 g/m$^2$ and the grammage of the at least one middle layer is at least 2.5 times higher than the grammage of the second outer layer, such as at least 4.0 times higher than the grammage of the second outer layer.
5. The multi-layered paperboard of any one of the preceding items, wherein the grammage of the multi-layered paperboard is above 250 g/m$^2$ and the grammage of the at least one middle layer is at least 4.0 times higher than the grammage of the second outer layer, such as at least 7.0 times higher than the grammage of the second outer layer.
6. The multi-layered paperboard of any one of the preceding items, wherein the grammage of the second outer layer is below 30 g/m$^2$, such as below 25 g/m$^2$, such as below 20 g/m$^2$, such as below 17 g/m$^2$.
7. The multi-layered paperboard of any one of the preceding items, wherein the grammage of the first outer layer is above 35 g/m$^2$, such as above 50 g/m$^2$, such as above 55 g/m$^2$.
8. The multi-layered paperboard of any one of the preceding items, wherein the grammage of said at least one middle layer is at least 50 g/m$^2$.
9. The multi-layered paperboard of any one of the preceding items, wherein said least one middle layer is formed from at least one furnish comprising mechanical pulp, such as chemitermomechanical pulp (CTMP).

10. The multi-layered paperboard of item 9, wherein said at least one furnish from which said at least one middle layer is formed further comprises broke pulp.
11. The multi-layered paperboard of any one of the preceding items, wherein the first outer layer is formed from a furnish comprising chemical pulp, such as kraft pulp, such as bleached kraft pulp.
12. The multi-layered paperboard of item 11, wherein the furnish from which the first outer layer is formed comprises at least 80% by dry weight kraft pulp.
13. The multi-layered paperboard of item 11 or 12, wherein the furnish from which the first outer layer is formed comprises at least 50% by dry weight hardwood pulp, such as at least 80% by dry weight hardwood pulp.
14. The multi-layered paperboard of any one of the preceding items, wherein the second outer layer is formed from a furnish comprising chemical pulp, such as kraft pulp.
15. The multi-layered paperboard of item 14, wherein the furnish from which the second outer layer is formed comprises at least 80% by dry weight kraft pulp, such as at least 90% by dry weight kraft pulp.
16. The multi-layered paperboard of any one of the preceding items, wherein the density of said at least one middle layer is lower than the density of the first outer layer and the density of the second outer layer.
17. A method of forming, in a full-scale paperboard machine, a multi-layered paperboard comprising a first outer layer, a second outer layer and at least one middle layer arranged between the first and the second outer layer, said method comprising the steps of:
    forming the first outer layer from a first furnish;
    forming the second outer layer from a second furnish; and
    forming said at least one middle layer from at least one middle layer furnish, wherein the flows and consistencies of the first and the second furnish are such that the grammage of the first outer layer is at least 2.0 times higher than the grammage of the second outer layer.
18. The method of item 17, wherein the flows and consistencies of the first and the second furnish are such that the grammage of the first outer layer is at least 2.5 times higher than the grammage of the second outer layer, such as at least 3.0 times higher than the grammage of the second outer layer.
19. The method of item 17 or 18, wherein the density of the at least one middle layer is below 550 kg/m$^3$, preferably below 490 kg/m$^3$, such as below 430 kg/m$^3$.
20. The method of any one of items 17-19, wherein the grammage of the paperboard is 150-250 g/m$^2$ and the flows and consistencies of the second furnish and the at least one middle layer furnish are such that the grammage of the at least one middle layer is at least 2.5 times higher than the grammage of the second outer layer, such as at least 4.0 times higher than the grammage of the second outer layer.
21. The method of any one of items 17-19, wherein the grammage of the paperboard is above 250 g/m$^2$ and the flows and consistencies of the second furnish and the at least one middle layer furnish are such that the grammage of the at least one middle layer is at least 4.0 times higher than the grammage of the second outer layer, such as at least 7.0 times higher than the grammage of the second outer layer.
22. The method of any one of items 17-21, wherein the flow and consistency of the second furnish are such that the grammage of the second outer layer is below 30 g/m$^2$, such as below 25 g/m$^2$, such as below 20 g/m$^2$.
23. The method of any one of items 17-22, wherein the flow and consistency of the first furnish are such that the grammage of the first outer layer is above 50 g/m$^2$, such as above 55 g/m$^2$.
24. The method of any one of items 17-23, wherein the flow and consistency of the at least one middle layer furnish are such that the grammage of the at least one middle layer is above 50 g/m$^2$, such as above 55 g/m$^2$.
25. The method of any one of items 17-24, wherein said at least one middle layer furnish comprises mechanical pulp, such as chemithermomechanical pulp (CTMP).
26. The method of any one of items 17-25, wherein said at least one middle layer furnish comprises broke pulp.
27. The method of any one of items 17-26, wherein the first furnish comprises chemical pulp, such as kraft pulp, such as bleached kraft pulp.
28. The method of item 27, wherein the first furnish comprises at least 80% by dry weight kraft pulp.
29. The method of item 27 or 28, wherein the first furnish comprises at least 50% by dry weight hardwood pulp, such as at least 80% by dry weight hardwood pulp.
30. The method of any one of items 17-29, wherein the second furnish comprises chemical pulp, such as kraft pulp.
31. The method of item 30, wherein second furnish comprises at least 80% by dry weight kraft pulp, such as at least 90% by dry weight kraft pulp.
32. The method of any one of items 17-31, wherein the Schopper-Riegler number according to ISO 5267-1: 1999 of the second furnish is above 25, such as above 30.
33. The method of any one of items 17-32, wherein the Schopper-Riegler number according to ISO 5267-1: 1999 is higher for the second furnish than for the first furnish.
34. The method of any one of items 17-33, wherein the Schopper-Riegler number according to ISO 5267-1: 1999 of the second furnish is above 50, such as above 60, such as above 70.
35. The method of item 34, wherein the flow and consistency of the second furnish are such that the grammage of the second outer layer is below 20 g/m$^2$, such as below 15 g/m$^2$.
36. The method of item 34 or 35, wherein second outer layer is coated or impregnated with a polymer, such as starch, CMC or PVOH, e.g. in a coating section arranged downstream of a drying section of the paperboard machine.
37. The method of item 36, wherein said coating or impregnation is carried out by means of a size press.
38. The method of any one of items 17-37, wherein the density of said at least one middle layer is lower than the density of the first outer layer and the density of the second outer layer.
39. The method of any one of items 17-38, wherein the jet-wire speed difference in the formation of the first outer layer and in the formation(s) of the at least one middle layer is +/−5-30 m/min.

Figure 1:
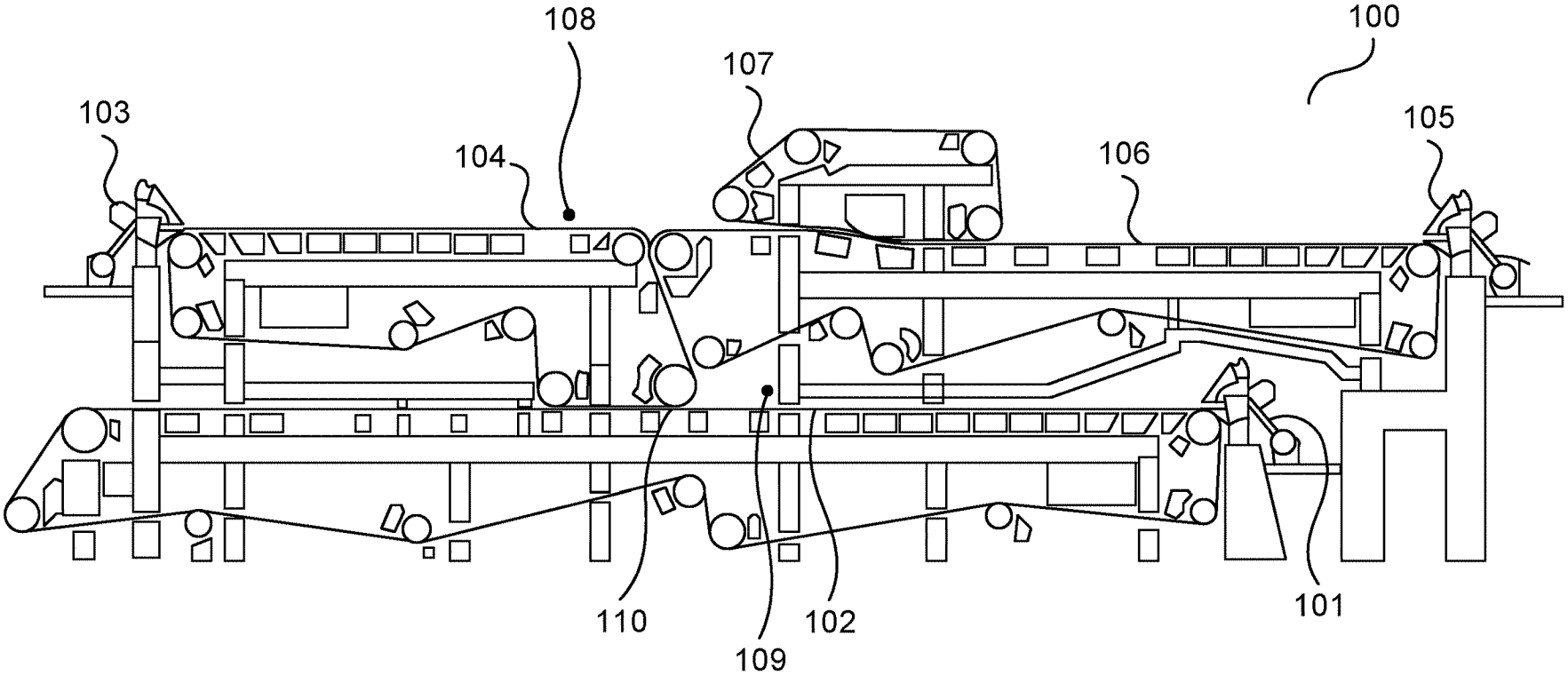
FIG. 1 illustrates a forming section 100 of a full-scale paperboard machine that can be used for carrying out an embodiment of the method of the present disclosure.

In the forming section 100, a first outer layer, which is intended for printing, is formed by means of a first headbox 101 feeding a first furnish onto first wire 102. A second outer layer, which is indented to be the reverse layer, is formed by means of second headbox 103 feeding a second furnish onto a second wire 104. A middle layer is formed by a middle layer headbox 105 feeding a middle layer furnish onto a middle layer wire 106. A top former 107 is arranged above the middle layer wire 106 to aid the formation of the middle layer (that may have high grammage). Before the second outer layer contacts the middle layer, starch is sprayed onto it by means of a starch spraying beam 108. Similarly, another starch spraying beam 109 sprays starch onto the first layer before it contacts the middle layer. All three layers are merged by a couch roll 110. The multi-layered web formed in the forming section 100 is transferred to a pressing section (not shown).

Figure 2:
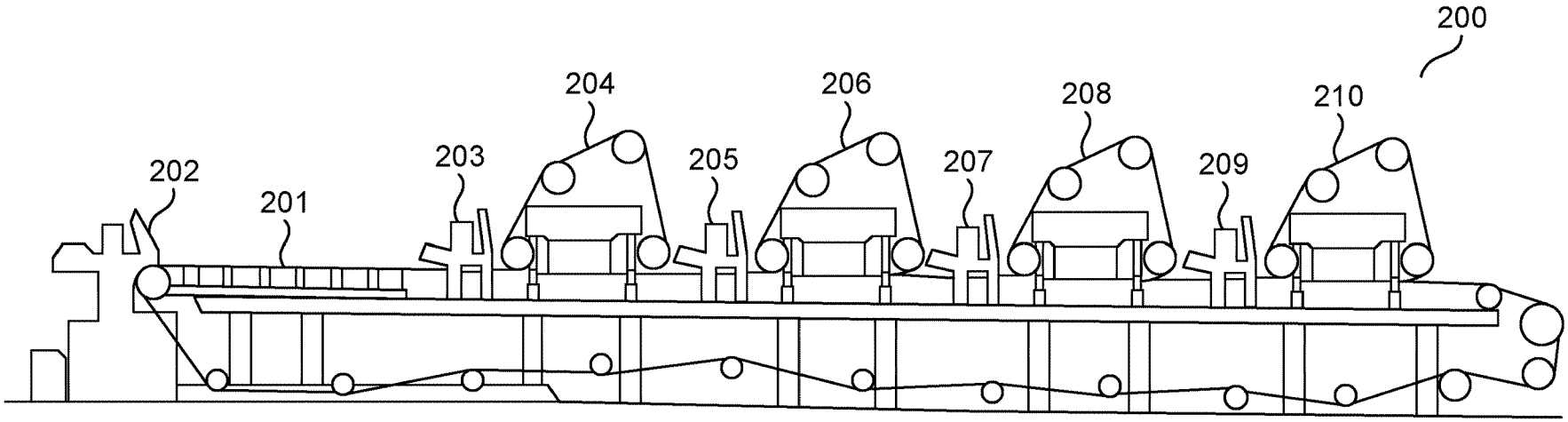

FIG. 2 illustrates another forming section 200 of a full-scale paperboard machine that can be used for carrying out another embodiment of the method of the present disclosure.

The forming section 200 contains a single fourdrinier wire 201. A first outer layer, which is intended for printing, is formed by means of a first headbox 202 feeding a first furnish onto the wire 201. A first middle layer is formed on the first outer layer by means of a second headbox 203 and a first top former 204. A second middle layer is formed on the first middle layer by means of a third headbox 205 and a second top former 206. A third middle layer is formed on the second middle layer by means of a fourth headbox 207 and a third top former 208. A second outer layer, which is intended to be the reverse layer, is formed on the third middle layer by means of a fifth headbox 209 and a fourth top former 210. The multi-layered web formed in the forming section 200 is transferred to a pressing section (not shown).

DETAILED DESCRIPTION

As a first aspect of the present disclosure, there is provided a multi-layered paperboard comprising a first outer layer, a second outer layer and at least one middle layer arranged between the first and the second outer layer. As understood by the skilled person, all these layers are based on cellulose fibres. The paperboard is asymmetric in the sense that the grammage of the first outer layer is at least 2.0 times higher than the grammage of the second outer layer.

Preferably, the grammage of the first outer layer is at least 2.5 times higher than the grammage of the second outer layer, such as at least 3.0 times higher than the grammage of the second outer layer, such as at least 3.5 times higher than the grammage of the second outer layer, such as at least 4.0 times higher than the grammage of the second outer layer.

To separate an individual layer from the multi-layered paperboard and thus facilitate measurements thereon, a FORTUNA Bandknife-Splitting Machine (Type AB 320 E/P) can be used. Such a machine that has been customized for paperboard splitting is commercially available and is used by several major companies in the paperboard field.

Alternatively, a surface grinding technique can be used to remove all layers but the layer of interest. Such a surface grinding is one of the services that are commercially available at RISE Bioeconomy (formerly Innventia) in Stockholm, Sweden.

In the context of the present disclosure, grammage is preferably measured according to ISO 536:2019.

The at least one middle layer of the paperboard may for example be one, two or three middle layers.

The grammage of the paperboard (excluding any coating layers) is typically 150-500 g/m$^2$. In one embodiment it is 150-250 g/m$^2$. In another embodiment, it is above 250 g/m$^2$, but not above 500 g/m$^2$.

The at least one middle layer typically constitutes a smaller portion of the paperboard when the paperboard grammage is lower. One reason for that is that an outer layer of a certain grammage is typically needed for satisfactory printability irrespective of the grammage of the other layers. Still, the grammage of the second outer layer is normally significantly lower than the grammage of the at least one middle layer.

When the grammage of the paperboard (excluding any coating layers) is relatively low, i.e. 150-250 g/m$^2$, the grammage of the at least one middle layer is typically least 2.5 times higher than the grammage of the second outer layer, such as at least 4.0 times higher than the grammage of the second outer layer.

When the grammage of the paperboard (excluding any coating layers) is relatively high, i.e. above 250 g/m$^2$, the grammage of the at least one middle layer is typically at least 4.0 times higher than the grammage of the second outer layer, such as at least 7.0 times higher than the grammage of the second outer layer.

Preferably, the grammage of the second outer layer is below 30 g/m$^2$, such as below 25 g/m$^2$, such as below 20 g/m$^2$, such as below 17 g/m$^2$.

The grammage of the first outer layer is typically above 35 g/m$^2$, such as above 50 g/m$^2$, such as above 55 g/m$^2$.

The grammage of the at least one middle layer is preferably at least 50 g/m$^2$, such as at least 65 g/m$^2$, such as at least 75 g/m$^2$. For the avoidance of doubt, the "grammage of the at least one middle layer" refer to all middle layers of the paperboard. If the paperboard has only one middle layer, it is referred to the grammage thereof. If the paperboard has two or three middle layers, it is referred to the combined grammage thereof.

When the at least one middle layer is at least two middle layers, the grammage thereof is preferably at least 80 g/m$^2$.

When the grammage of the paperboard (excluding any coating layers) is relatively high, i.e. above 250 g/m$^2$, the grammage of the at least one middle layer is preferably at least 100 g/m$^2$, such as at least 140 g/m$^2$.

The at least one middle layer is formed from at least one furnish. In case of more than one middle layer, the middle layers may be formed from furnishes having the same or different compositions. In any case, the furnish(es) from which the at least one middle layer is (are) formed ("the middle layer furnish(es)") preferably comprises mechanical pulp, such as chemitermomechanical pulp (CTMP). The proportion (by dry weight) of mechanical pulp (preferably CTMP) in the middle layer furnish(es) is preferably at least 20%, more preferably at least 30%, such as at least 40%. In a preferred embodiment, the middle layer furnish(es) thus comprise(s) at least 30% by dry weight and more preferably at least 40% by dry weight CTMP.

The inclusion of mechanical pulp is advantageous since it increases the bulk of the middle layer(s). However, the mechanical pulp may reduce the z strength and/or the Scott Bond value. Hence it is preferred to include at least one strength chemical (also referred to as strength agent) in the middle layer furnish(es). As an example, the middle layer furnish(es) may comprise cationic starch and CMC or microfibrillated cellulose (MFC). Another option is to combine the cationic starch with anionic polyacrylamide (A-PAM) or anionic starch. Yet another option is to combine cationic polyvinylamine (PVAm) with A-PAM, CMC or MFC. The middle layer furnish(es) may further comprise retention chemicals known to the skilled person.

In addition to mechanical pulp, the middle layer furnish(es) preferably comprises broke pulp. The proportion (by dry weight) of broke pulp in the middle layer furnish(es) may be at least 20%, such as at least 30%, such as at least 40%.

In a preferred embodiment, the middle layer furnish(es) thus comprise(s) at least 40% by dry weight CTMP and at least 40% by dry weight broke pulp.

In addition to mechanical pulp and/or broke pulp, the middle layer furnish(es) may comprise chemical pulp, such as kraft pulp. The proportion (by dry weight) of chemical pulp is preferably lower than the proportion of mechanical pulp. In one embodiment, the proportion (by dry weight) of chemical pulp in the middle layer furnish(es) is 5%-20%.

In one embodiment, the at least one middle layer comprise(s) hydrophobic size, such as rosin size, AKD and/or ASA. As an example, the middle layer may comprise both rosin size and AKD or ASA. The use of AKD or ASA is particularly preferred when the paperboard is intended for use in liquid food packaging.

The first outer layer is typically formed from a furnish comprising chemical pulp, such as kraft pulp, such as bleached kraft pulp. In one embodiment, the proportion of kraft pulp in this furnish is at least 80% by dry weight. Further, the proportion of hardwood pulp in this furnish is preferably at least 50% by dry weight, such as at least 80% by dry weight. At least 80% softwood in this furnish is however not excluded.

The second outer layer is typically formed from a furnish comprising chemical pulp, such as kraft pulp. In one embodiment, this furnish comprises at least 80% by dry weight kraft pulp, such as at least 90% by dry weight kraft pulp.

In one embodiment, the first and the second outer layer comprise hydrophobic size, such as rosin size, AKD and/or ASA. As an example, the outer layers may comprise both rosin size and AKD or ASA. As already mentioned, the use of AKD or ASA is particularly preferred when the paperboard is intended for use in liquid food packaging.

It is preferred to include at least one strength chemical, such as starch, in the furnishes used for forming the outer layers. Further, these furnishes typically comprise at least one retention agent.

In a highly preferred embodiment, the density of the at least one middle layer is lower than the density of the first outer layer and the density of the second outer layer. If there is only one middle layer, the density thereof is thus less than the densities of the other layers (not including any coating layers). If there are two or three middle layers, each of them preferably has lower density than the other layers (not including any coating layers).

In one embodiment, each middle layer has a density that is at least 25% lower than the density of the first outer layer and the density of the second outer layer The density of the at least one middle layer is preferably below 550 kg/m$^3$, more preferably below 490 kg/m$^3$, such as below 430 kg/m$^3$.

The density of the second outer layer may be above 600 kg/m$^3$, such as above 650 kg/m$^3$.

The density of the first outer layer may be above 600 kg/m$^3$.

In the context of the present disclosure, density is preferably measured according to ISO 534:2011.

Further, the density of the second outer layer may be higher than the density of the first outer layer. This density difference may be the effect of that the furnish that is used to form the second outer layer has a higher SR number than the furnish used to form the first outer layer (further discussed below).

In an embodiment, the second outer layer is coated or impregnated with polyvinyl alcohol (PVOH), carboxymethyl cellulose (CMC) or starch. This embodiment may be particularly advantageous if the density of the second outer layer is above 800 kg/m$^3$. This is further discussed below.

As a second aspect of the present disclosure, there is provided a method of forming, in a full-scale paperboard machine, a multi-layered paperboard comprising a first outer layer, a second outer layer and at least one middle layer arranged between the first and the second outer layer.

A full-scale paperboard machine comprises a forming section, a pressing section and a drying section. The full-scale paperboard machine may further comprise a coating section arranged downstream the drying section. In one embodiment, the full-scale paperboard machine comprises at least on calendar arranged downstream the drying section or in a downstream region of the drying section. When the coating section is included, the calendar is typically arranged upstream thereof. A full-scale paperboard machine typically produces at least 50,000 tonnes of paperboard per year.

The method comprises the steps of:

forming the first outer layer from a first furnish;

forming the second outer layer from a second furnish; and forming said at least one middle layer from at least one middle layer furnish, wherein the flows and consistencies of the first and the second furnish are such that the grammage of the first outer layer is at least 2.0 times higher than the grammage of the second outer layer.

In one embodiment, a first headbox feeds the first furnish to a first wire in the formation of the first outer layer. Likewise, a second headbox feeds the second furnish to a second wire in the formation of the second outer layer. Finally, at least one middle layer headbox feed(s) the at least one middle layer furnish to at least one middle layer wire to form the at least one middle layer. An example of such an embodiment is further described with reference to FIG. 1.

In an alternative embodiment, headboxes for each layer are arranged along a single fourdrinier wire in a forming section also containing top formers. An example of such an embodiment is further described with reference to FIG. 2.

In the example of FIG. 2, one primary head box is followed by four secondary headboxes. However, the number of secondary headboxes may also be two or three.

What is described above in connection to the first aspect applies to the second aspect mutatis mutandis.

To facilitate production (e.g. to efficiently prevent dusting), the second furnish advantageously has a Schopper-Riegler (SR) number according to ISO 5267-1:1999 above 25, such as above 30. A typical upper limit may be 45. To achieve such an SR number, the pulps used for the second layer furnish are preferably subjected to low consistency (SR) refining.

The first outer layer is of much higher grammage and therefore, an equally high SR number is not needed for the furnish used to form it. Hence the SR number (ISO 5267-1:1999) is in one embodiment higher for the second furnish than for the first furnish. As an example, the SR number of the second furnish may be at least 20% higher than the SR number of the first furnish.

The method of the second aspect provides the possibility of forming a second outer layer that has barrier properties. When the grammage of the second outer layer is reduced, the traditional paperboard machine adapted to reverse layers of normal grammage has excess dewatering and drying capacity. This leaves room for extensive refining of the pulps of the second furnish (and the existing refiners may be sufficient for such extensive refining given the reduced grammage). For example, the degree of refining can be such that the SR number of the second furnish is above 50 and even above 60 or 70. This may result in a second outer layer having a density of at least 800 kg/m$^3$. The dense second outer layer formed from the highly refined pulps can provide the barrier properties, such as oxygen barrier properties. These barrier properties may be improved further by coating or impregnating the second outer layer with a polymer, such as polyvinyl alcohol (PVOH), carboxymethyl cellulose (CMC) or starch. Equipment for reverse side coating is often available in full-scale paperboard machines (typically downstream the drying section) and may be used for the barrier-improving coating or impregnation.

It is often beneficial to orient the fibres of the printing layer and the middle layer(s) in the machine direction (MD) to reduce the cracking tendency of the printing layer in packaging applications. However, such MD orientation of the at least one middle layer may increase the cracking tendency of the reverse layer. In case of the paperboard of the present disclosure, any cracking of the second outer layer is however less of a concern since this layer is intended to be covered by a barrier paper.

One way of orienting the fibres in the MD is to have a difference between the jet speed and the wire speed. In one embodiment, the jet-wire speed difference in the formation of the first outer layer and in the formation(s) of the at least one middle layer is +/−5-30 m/min. For the avoidance of doubt, this means that the speed of the wire is 5-30 m/min faster or 5-30 m/min slower than the speed of the jet from the headbox.

To improve the adhesion between the layers of the paperboard, in particular when using a multi wire forming section as in FIG. 1, starch may be applied between the layers in the forming section before they are merged.

EXAMPLES

Example 1

The effects of some embodiments of the paperboard of the present disclosure were calculated. In these calculations, the density and tensile stiffness values were set according to table 1.

TABLE 1

| | Density (kg/m$^3$) | Tensile stiffness index (kNm/g) |
|---|---|---|
| Print layer | 646 | 5.8 |
| Middle layer | 390 | 4.0 |
| Reverse layer | 665 | 5.9 |

A "traditional" paperboard design having a 70 g/m$^2$ print layer, a 130 g/m$^2$ middle layer and 45 g/m$^2$ reverse layer was used as a first reference.

In the inventive paperboards, the grammage of the middle layer was increased at the expense of the grammage of the reverse layer such that the print layer to reverse layer grammage ratio was above two and the middle layer to reverse layer grammage ratio was above four.

In addition to paperboard, the structures for which the calculations were made contained a barrier paper provided on the reverse side. Any impact of the adhesive used for attaching the barrier paper to the reverse side of the paperboard has been disregarded in the calculations. The density and tensile stiffness index of this barrier paper was set to 962 kg/m$^3$ and 7.2 kNm/g, respectively.

In example 1, it is assumed that the grammage of the print layer of the "traditional" paperboard is optimized to 70 g/m$^2$ (based on i.a. printing properties) and should not be altered. Consequently, all paperboards of example 1 have the print layer grammage of 70 g/m$^2$.

In the first reference paperboard and the first to fourth inventive paperboards of example 1, the grammage is the same (245 g/m$^2$). In a second reference paperboard and the fifth inventive paperboard, the grammage is reduced by 7 g/m$^2$ (a reduction of 2.9%). This reduction may appear small, but in a full-scale machine producing tens or hundreds of thousands of tonnes of paperboard each year, such a reduction has a significant effect on the economics and environmental impact of the paperboard production. In the second refence paperboard, it was assumed that the skilled person who wanted reduce the grammage of the traditional paperboard made the same proportional reduction to the middle layer and the reverse layer, but left the grammage of the print layer unchanged for the reason given above.

The results of the calculations are presented in table 2 below.

TABLE 2

| | Ref 1 | Inv 1 | Inv 2 | Inv 3 | Inv 4 | Ref 2 | Inv 5 |
|---|---|---|---|---|---|---|---|
| Print layer grammage (g/m$^2$) | 70 | 70 | 70 | 70 | 70 | 70 | 70 |
| Middle layer grammage (g/m$^2$) | 130 | 145 | 155 | 160 | 163 | 125 | 156 |
| Reverse layer grammage (g/m$^2$) | 45 | 30 | 20 | 15 | 12 | 43 | 12 |
| Barrier paper grammage (g/m$^2$) | 50 | 50 | 50 | 50 | 50 | 50 | 50 |
| Total grammage (g/m$^2$) | 295 | 295 | 295 | 295 | 295 | 288 | 288 |
| Grammage ratio (Print/Reverse) | 1.56 | 2.33 | 3.50 | 4.67 | 5.83 | 1.63 | 5.83 |
| Grammage ratio (Middle/Reverse) | 2.89 | 4.83 | 7.75 | 10.67 | 13.58 | 2.91 | 13.00 |
| Bending resistance (mN) | 708 | 742 | 761 | 769 | 773 | 655 | 715 |

Notably, all the inventive structures of the grammage 295 g/m$^2$ (Inv 1-4) have significantly higher bending stiffness values than the 295 g/m$^2$ reference structure (Ref 1). It is also notable that the 288 g/m$^2$ inventive structure (Inv 5) has a higher bending resistance than Ref 1 despite having a lower grammage. A comparison of Inv 5 to Ref 2 shows the effect of "sacrificing" the reverse layer in favour of the middle layer when reducing the grammage.

Example 2

The effects of some other embodiments of the paperboard of the present disclosure were calculated. In these calculations, the densities and tensile stiffness index values of table 1 above were used.

A "traditional" paperboard design having a 60 g/m$^2$ print layer, a 130 g/m$^2$ middle layer and 45 g/m$^2$ reverse layer was used as a first reference.

In the inventive paperboards, the grammage of the middle layer was increased at the expense of the grammage of the reverse layer such that the print layer to reverse layer grammage ratio was at least two and the middle layer to reverse layer grammage ratio was above four.

In addition to paperboard, the structures for which the calculations were made contained a barrier paper provided on the reverse side. Any impact of the adhesive used for attaching the barrier paper to the reverse side of the paperboard has been disregarded in the calculations. As in Example 1, the density and tensile stiffness index of this barrier paper was set to 962 kg/m$^3$ and 7.2 kNm/g, respectively.

In example 2, it is assumed that the grammage of the print layer of the "traditional" paperboard is optimized to 60 g/m$^2$ (based on i.a. printing properties) and should not be altered. Consequently, all paperboards of example 1 have the print layer grammage of 60 g/m$^2$.

In the first reference paperboard and the first to fourth inventive paperboards of example 2, the grammage is the same (235 g/m$^2$). In a second reference paperboard and the fifth inventive paperboard, the grammage is reduced by 7 g/m$^2$ (a reduction of 3.0%). As noted above, this reduction may appear small, but in a full-scale machine producing tens or hundreds of thousands of tonnes of paperboard each year, such a reduction has a significant effect on the economics and environmental impact of the paperboard production. In the second refence paperboard, it was assumed that the skilled person who wanted reduce the grammage of the traditional paperboard made the same proportional reduction to the middle layer and the reverse layer, but left the grammage of the print layer unchanged for the reason given above.

The results of the calculations are presented in table 3 below.

TABLE 3

| | Ref 1 | Inv 1 | Inv 2 | Inv 3 | Inv 4 | Ref 2 | Inv 5 |
|---|---|---|---|---|---|---|---|
| Print layer grammage (g/m$^2$) | 60 | 60 | 60 | 60 | 60 | 60 | 60 |
| Middle layer grammage (g/m$^2$) | 130 | 145 | 155 | 160 | 163 | 125 | 156 |
| Reverse layer grammage (g/m$^2$) | 45 | 30 | 20 | 15 | 12 | 43 | 12 |
| Barrier paper grammage (g/m$^2$) | 50 | 50 | 50 | 50 | 50 | 50 | 50 |
| Total grammage (g/m$^2$) | 285 | 285 | 285 | 285 | 285 | 278 | 278 |
| Grammage ratio (Print/Reverse) | 1.56 | 2.00 | 3.00 | 4.00 | 5.00 | 1.63 | 5.83 |
| Grammage ratio (Middle/Reverse) | 2.89 | 4.83 | 7.75 | 10.67 | 13.58 | 2.91 | 13.00 |
| Bending resistance (mN) | 645 | 678 | 696 | 703 | 708 | 596 | 652 |

Notably, all the inventive structures of the grammage 285 g/m$^2$ (Inv 1-4) have significantly higher bending stiffness values than the 285 g/m$^2$ reference structure (Ref 1). It is also notable that the 278 g/m$^2$ inventive structure (Inv 5) has a higher bending resistance than Ref 1 despite having a lower grammage. A comparison of Inv 5 to Ref 2 shows the effect of "sacrificing" the reverse layer in favour of the middle layer when reducing the grammage.

Example 3

The effects of yet some other embodiments of the paperboard of the present disclosure were calculated. In these calculations, the densities and tensile stiffness index values of table 1 above were used.

A "traditional" paperboard design having a 65 g/m$^2$ print layer, a 62 g/m$^2$ middle layer and 45 g/m$^2$ reverse layer was used as a first reference.

In the inventive paperboards, the grammage of the middle layer was increased at the expense of the grammage of the reverse layer such that the print layer to reverse layer grammage ratio was above two and the middle layer to reverse layer grammage ratio was above four.

In addition to paperboard, the structures for which the calculations were made contained a barrier paper provided on the reverse side. Any impact of the adhesive used for attaching the barrier paper to the reverse side of the paperboard has been disregarded in the calculations. As in Example 1, the density and tensile stiffness index of this barrier paper was set to 962 kg/m$^3$ and 7.2 kNm/g, respectively.

In example 3, it is assumed that the grammage of the print layer of the "traditional" paperboard is optimized to 65 g/m$^2$ (based on i.a. printing properties) and should not be altered. Consequently, all paperboards of example 1 have the print layer grammage of 65 g/m$^2$.

In the first reference paperboard and the first to fourth inventive paperboards of example 3, the grammage is the same (172 g/m$^2$). In a second reference paperboard and the fifth inventive paperboard, the grammage is reduced by 7 g/m$^2$ (a reduction of 4.1%). As noted above, this reduction may appear small, but in a full-scale machine producing tens or hundreds of thousands of tonnes of paperboard each year, such a reduction has a significant effect on the economics and environmental impact of the paperboard production. In the second refence paperboard, it was assumed that the skilled person who wanted to reduce the grammage of the traditional paperboard made the same proportional reduction to the middle layer and the reverse layer, but left the grammage of the print layer unchanged for the reason given above.

The results of the calculations are presented in table 3 below.

TABLE 3

| | Ref 1 | Inv 1 | Inv 2 | Inv 3 | Inv 4 | Ref 2 | Inv 5 |
|---|---|---|---|---|---|---|---|
| Print layer grammage ($g/m^2$) | 65 | 65 | 65 | 65 | 65 | 65 | 65 |
| Middle layer grammage ($g/m^2$) | 62 | 77 | 87 | 92 | 95 | 57 | 88 |
| Reverse layer grammage ($g/m^2$) | 45 | 30 | 20 | 15 | 12 | 43 | 12 |
| Barrier paper grammage ($g/m^2$) | 50 | 50 | 50 | 50 | 50 | 50 | 50 |
| Total grammage ($g/m^2$) | 222 | 222 | 222 | 222 | 222 | 215 | 215 |
| Grammage ratio (Print/Reverse) | 1.44 | 2.17 | 3.25 | 4.33 | 5.42 | 1.51 | 5.42 |
| Grammage ratio (Middle/Reverse) | 1.38 | 2.57 | 4.35 | 6.13 | 7.92 | 1.33 | 7.33 |
| Bending resistance (mN) | 247 | 271 | 286 | 293 | 297 | 220 | 264 |

Notably, all the inventive structures of the grammage 222 $g/m^2$ (Inv 1-4) have significantly higher bending stiffness values than the 222 $g/m^2$ reference structure (Ref 1). The bending resistance of Inv 4 is no less than 20% higher than that of Ref 1. It is also notable that the 215 $g/m^2$ inventive structure (Inv 5) has a higher bending resistance than Ref 1 despite having a lower grammage. A comparison of Inv 5 to Ref 2 shows the effect of "sacrificing" the reverse layer in favour of the middle layer when reducing the grammage.

The invention claimed is:

1. A multi-layered paperboard comprising a first outer layer, a second outer layer and at least one middle layer arranged between the first and the second outer layer, wherein all these layers are based on cellulose fibers and wherein the grammage of the first outer layer is at least 2.0 times higher than the grammage of the second outer layer, the grammage of the second outer layer is below 25 $g/m^2$ and the density of the at least one middle layer is lower than the density of the first outer layer and the density of the second outer layer.

2. The multi-layered paperboard of claim 1, wherein the grammage of the first outer layer is at least 2.5 times higher than the grammage of the second outer layer.

3. The multi-layered paperboard of claim 1, wherein the density of the at least one middle layer is below 550 kg/m3.

4. The multi-layered paperboard of claim 1, wherein the grammage of the multi-layered paperboard is 150-250 $g/m^2$ and the grammage of the middle layer is at least 2.5 times higher than the grammage of the second outer layer.

5. The multi-layered paperboard of claim 1, wherein the grammage of the multi-layered paperboard is above 250 $g/m^2$ and the grammage of the middle layer is at least 4.0 times higher than the grammage of the second outer layer.

6. The multi-layered paperboard of claim 1, wherein the grammage of the second outer layer is below 20 $g/m^2$.

7. The multi-layered paperboard of claim 1, wherein the grammage of the first outer layer is above 35 $g/m^2$.

8. The multi-layered paperboard of claim 7, wherein said at least one furnish from which said at least one middle layer is formed further comprises broke pulp.

9. The multi-layered paperboard of claim 1, wherein said least one middle layer is formed from at least one furnish comprising mechanical pulp.

10. The multi-layered paperboard of claim 9, wherein the mechanical pulp is chemitermomechanical pulp (CTMP).

11. A method of forming, in a full-scale paperboard machine, a multi-layered paperboard comprising a first outer layer, a second outer layer and at least one middle layer arranged between the first and the second outer layer, said method comprising the steps of:

forming the first outer layer from a first furnish;

forming the second outer layer from a second furnish; and forming said at least one middle layer from at least one middle layer furnish, wherein the flows and consistencies of the first and the second furnish are such that the grammage of the first outer layer is at least 2.0 times higher than the grammage of the second outer layer, the flow and consistency of the second furnish are such that the grammage of the second outer layer is below 25 $g/m^2$ and the density of the at least one middle layer is lower than the density of the first outer layer and the density of the second outer layer.

12. The method of claim 11, wherein the density of the at least one middle layer is below 550 $kg/m^3$.

13. The method of claim 11, wherein said at least one middle layer furnish comprises mechanical pulp.

14. The method of claim 13, wherein the mechanical pulp is chosen from chemithermomechanical pulp (CTMP), or broke pulp.

15. The method of claim 11, wherein the Schopper-Riegler number according to ISO 5267-1:1999 of the second furnish is above 25.

16. The method of claim 11, wherein the Schopper-Riegler number according to ISO 5267-1:1999 is higher for the second furnish than for the first furnish.

17. The method of claim 11, wherein the jet-wire speed difference in the formation of the first outer layer and in the formation(s) of the at least one middle layer is +/−5-30 m/min.

* * * * *